US005501237A

United States Patent [19]

Young et al.

[11] Patent Number: 5,501,237

[45] Date of Patent: Mar. 26, 1996

[54] TOBACCO RECONSTITUTION PROCESS

[75] Inventors: Harvey J. Young, Advance; Edward J. S. Sohn, Lewisville, both of N.C.

[73] Assignee: R. J. Reynolds Tobacco Company, Winston-Salem, N.C.

[21] Appl. No.: 769,914

[22] Filed: Sep. 30, 1991

[51] Int. Cl.[6] ..... A24B 15/24

[52] U.S. Cl. ..... 131/297; 131/298

[58] Field of Search ..... 131/297, 298

[56] References Cited

U.S. PATENT DOCUMENTS

| | | |
|---|---|---|
| 1,016,844 | 2/1912 | Moonelis . |
| 1,068,403 | 7/1913 | Maier . |
| 3,353,541 | 11/1967 | Hind et al. . |
| 3,386,449 | 6/1968 | Hind . |
| 3,386,450 | 6/1968 | Seligman et al. . |
| 3,398,754 | 8/1968 | Tughan . |
| 3,409,026 | 11/1968 | Hind et al. . |
| 3,411,514 | 11/1968 | Hind et al. . |
| 3,411,515 | 11/1968 | Hind et al. . |
| 3,420,241 | 1/1969 | Hind et al. . |
| 3,428,053 | 2/1969 | Schoenbaum et al. . |
| 3,435,829 | 4/1969 | Hind et al. . |
| 3,464,422 | 9/1969 | Light et al. . |
| 3,483,874 | 12/1969 | Hind . |
| 3,540,455 | 11/1970 | Fiore et al. . |
| 3,616,801 | 11/1971 | Hind . |
| 3,847,164 | 11/1974 | Mattina et al. . |
| 4,182,349 | 1/1980 | Selke . |
| 4,270,552 | 6/1981 | Jenkins et al. . |
| 4,337,783 | 7/1982 | Hooper et al. . |
| 4,421,126 | 12/1983 | Gellatly . |
| 4,674,519 | 6/1987 | Keritsis et al. . |
| 4,962,774 | 10/1990 | Thomasson et al. . |
| 4,972,854 | 11/1990 | Kiernan et al. . |
| 4,987,906 | 1/1991 | Young et al. . |

OTHER PUBLICATIONS

Silberstein, TJI, vol. 1, pp. 26–29 (1985).

Tobacco Encyclopedia, Edited by Voges, pp. 389–390 TJI (1984).

*Primary Examiner*—William M. Pierce

[57] ABSTRACT

Reconstituted tobacco having good wet strength is provided. Tobacco material is extracted with water to yield an insoluble portion and an aqueous portion containing water soluble tobacco components. The insoluble portion is formed into a sheet-like shape and contacted with a pectin release agent. Alternatively, the insoluble portion is contacted with pectin release agent and then formed into a sheet-like shape. The extract then is applied to the insoluble portion which has been formed into a sheet-like shape. The resulting tobacco composition is dried to yield a reconstituted tobacco material.

38 Claims, 2 Drawing Sheets

TOBACCO RECONSTITUTION PROCESS

BACKGROUND OF THE INVENTION

The present invention relates to the processing of plant materials, and in particular to a method for providing a reconstituted plant material such as a reconstituted tobacco material.

Cigarettes are popular smoking articles which have a substantially cylindrical rod shaped structure and include a charge of tobacco material surrounded by a wrapper, such as paper, thereby forming a so-called "tobacco rod." It has become desirable to manufacture a cigarette having a cylindrical filter aligned in an end-to-end relationship with the tobacco rod. Typically, a filter includes cellulose acetate circumscribed by plug wrap, and is attached to the tobacco rod using a circumscribing tipping material. See, Baker, *Prog. Ener. Combust. Sci.*, Vol. 7 pp. 135–153 (1981).

Typical cigarettes include blends of various tobaccos, such as the flue-cured, Burley, Maryland and Oriental tobaccos. Cigarette blends also can include certain amounts of processed and reconstituted tobacco materials. Reconstituted tobacco materials often are manufactured from tobacco stems, dust and scrap using papermaking processes. See, *Tobacco Encyclopedia*, edit. by Voges, pp. 389–390, TJI (1984) and U.S. Pat. Nos. 4,962,774 to Thomasson, et al. and 4,987,906 to Young, et al. See, also, U.S. Pat. No. 4,421,126 to Gellatly, and U.S. patent application Ser. Nos. 647,329, filed Jan. 28, 1991, now U.S. Pat. No. 5,143,097 and 710,273, filed Jun. 4, 1991.

It would be desirable to provide an efficient and effective process for providing a reconstitution process for a plant material such as a tobacco material.

SUMMARY OF THE INVENTION

The present invention relates to a process for providing a reconstituted plant material, such as a reconstituted tobacco material. The process involves extracting components from a plant material (e.g., tobacco material) using a solvent having an aqueous character. As such, an aqueous tobacco extract and a water insoluble tobacco portion are provided. At least a portion of the aqueous extract is separated from the insoluble portion. The insoluble portion (i.e., extracted tobacco material), which has a high moisture content, then is contacted with an agent capable of destroying alkaline earth metal crosslinks of pectins present within the extracted tobacco material (i.e., pectin release agent or crosslink destruction agent), under conditions so as to release the pectins from within the extracted tobacco material thereby providing the pectins with the ability or capability to experience movement throughout the tobacco material. In a preferred aspect, the insoluble portion is formed into a desired shape (e.g., a sheet-like shape) prior to being contacted with the pectin release agent; however, the extracted tobacco material can be contacted with the pectin release agent prior to being formed into the predetermined shape. The insoluble portion then is contacted with an agent capable of causing the pectins which have been released to undergo crosslinking, or is otherwise subjected to conditions sufficient to cause the pectins which have been released to undergo crosslinking. The agent capable of causing released pectins to undergo crosslinking most preferably is a source of alkaline earth metal ions, such as calcium ions. In a highly preferred aspect, the tobacco extract is a suitable source of such alkaline earth metal ions. The aqueous tobacco extract, which is provided in a form capable of being applied to the formed insoluble portion, then is applied to the formed insoluble portion; and the resulting tobacco composition is dried to the desired moisture level, thereby providing a reconstituted tobacco material.

The resulting reconstituted tobacco material can be employed using techniques known in the art. For example, the reconstituted tobacco material can be provided in a sheet-like form having a thickness approximating that of tobacco leaf lamina; and the material can be blended with other tobacco materials, cut to the desired size, and employed as smokable cut filler for the manufacture of cigarettes.

Reconstituted tobacco materials which are manufactured according to the process of the present invention have excellent smoking properties; and when smoked, exhibit desirable sensory attributes. The reconstituted tobacco materials also exhibit good wet strength.

DETAILED DESCRIPTION OF THE PREFERRED EMBODIMENTS

Figure 1:
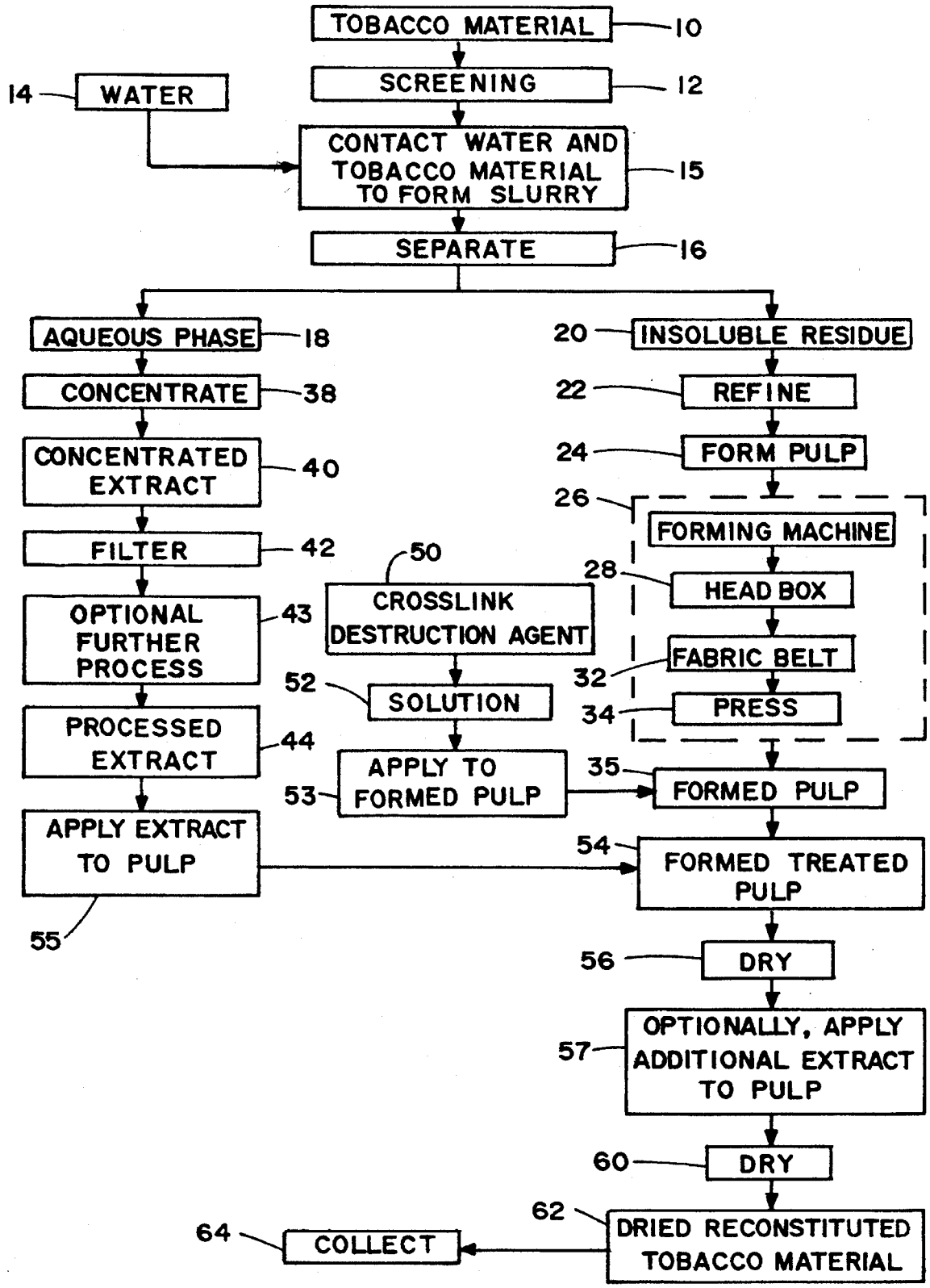
FIGS. 1 and 2 are schematic diagrams of steps representative of embodiments of the present invention.

Referring to FIG. 1, tobacco material 10 can have the form of stem, dust, scrap, strip, or the like. One or more of the aforementioned exemplary tobacco materials can be provided separately, or as blends thereof. The tobacco material can be screened 12 or otherwise processed to remove impurities (e.g., sand) therefrom. Techniques for removing particular impurities from particular tobacco materials can vary, depending upon factors such as the form of the tobacco material being processed; and such techniques will be apparent to the skilled artisan.

The tobacco material 10 is contacted with tap water 14 under conditions such that water soluble components of the tobacco are extracted by the water. The mixture 15, which is an aqueous tobacco slurry, is subjected to separation conditions 16 so as to provide tobacco extract components in an aqueous phase 18 (i.e., water and extract) and a water insoluble tobacco residue 20. The manner of separation of the liquid extract from the insoluble residue can vary. Typical separation techniques involve centrifugation, the use of one or more passes of the mixture through a screw press, or the like. If desired, the liquid extract can be filtered or centrifuged to provide a liquid extract essentially absent of insoluble materials and precipitates.

The water insoluble residue 20 (i.e., extracted tobacco material) can be refined 22 using papermaking type refiners such as disc refiners, conical refiners, or the like. As such, the residue is subjected to a size reduction step and thereby is formed into pulp 24 for use in the subsequent manufacture of a reconstituted tobacco product. The refined pulp 24 is transferred to a forming machine 26 consisting of a headbox 28, a continuous fabric or wire mesh belt 32, and a series of presses 34. Such a forming machine is common in the papermaking industry. The selection and operation of a forming machine will be apparent to the skilled artisan. The pulp is laid onto the fabric or wire mesh belt 32 (e.g., after being laid onto a forming cylinder) and is thereby formed into a sheet-like shape. Excess water is released from the pulp using the series of presses 34 after initial dewatering on the fabric or wire belt. Preferably, forming water removed from the pulp through the fabric or wire belt is recycled back to the headbox to provide a desirably diluted pulp which is in turn laid onto the belt. As such, a formed pulp 35 is provided.

Meanwhile, the liquid extract 18 is concentrated 38 by heating or other such method (e.g., using a forced circulation evaporator), to evaporate a desired amount of the water. For example, the extract can be passed over steam-filled tubes or through stem jacketed tubes. Optionally, a concentrated extract 40 is filtered 42 (e.g., using a screening technique, a high pressure ceramic disc filtration unit, or the like), in order to remove suspended solid materials from the liquid extract. Such a liquid extract 40 normally exhibits a pH of about 4.5 to about 5.5.

The liquid extract 18 or concentrated liquid extract 40 optionally can be subjected to further processing steps 43 to provide a processed liquid extract 44. Such processing steps can involve (i) heat treating the liquid extract, (ii) contacting the liquid extract with additives, and/or (iii) contacting the liquid extract with another tobacco extract. See, for example, U.S. patent application Ser. No. 710,273, filed Jun. 4, 1991, which is incorporated herein by reference.

A crosslink destruction 50 agent capable of releasing pectins present in the extracted tobacco material 20 is provided. A preferred crosslink destruction agent 50 is diammonium hydrogen orthophosphate. The pectin release agent 50 is provided as an aqueous solution 52, and the solution is applied 53 to the formed pulp 35 to form a treated pulp 54. The pectin release agent preferably is applied to the formed pulp using spraying or size press techniques. Typically enough aqueous solution 52 including diammonium hydrogen orthophosphate as a pectin release agent 50 is applied to the pulp to provide about 2 percent to about 5 percent addition of pectin release agent to the pulp, based on the dry weight of the pulp. Preferred techniques provide for penetration of the crosslink destruction agent into the formed pulp so as to provide intimate contact of the crosslink destruction agent and tobacco pulp. As such, the preferred method of contact involves mechanical force (e.g., as provided by pressing or squeezing, or as provided by a pressurized or atomized spray) so as to promote as much physical mixing of the pectin release agent and tobacco pulp as possible.

The liquid extract 40 or processed liquid extract 44 then is applied 55 to the formed, treated pulp 54 on the fabric or wire mesh belt 32 using a spraying technique, or a similar application means (e.g., size press techniques). For example, liquid extract is sprayed onto the pulp, and the selection and operation of a particular spraying apparatus will be apparent to the skilled artisan.

The sheet-like pulp having the liquid extract applied thereto is passed through a dryer 56 such as an apron dryer, or the like. If desired, a further amount of the liquid extract 57 can be applied to one or both sides of the formed pulp, and the resulting material can be passed through another dryer 60. Alternatively, the resulting material can be passed through the dryer or dryers more than one time. Dried reconstituted tobacco material 62 which results can be collected 64 and is processed further as required for use as smokable filler for cigarettes. For example, the reconstituted tobacco material can be cased and/or top dressed, cut or shredded to the desired size, heat treated, volume expanded, or otherwise processed.

Figure 2:
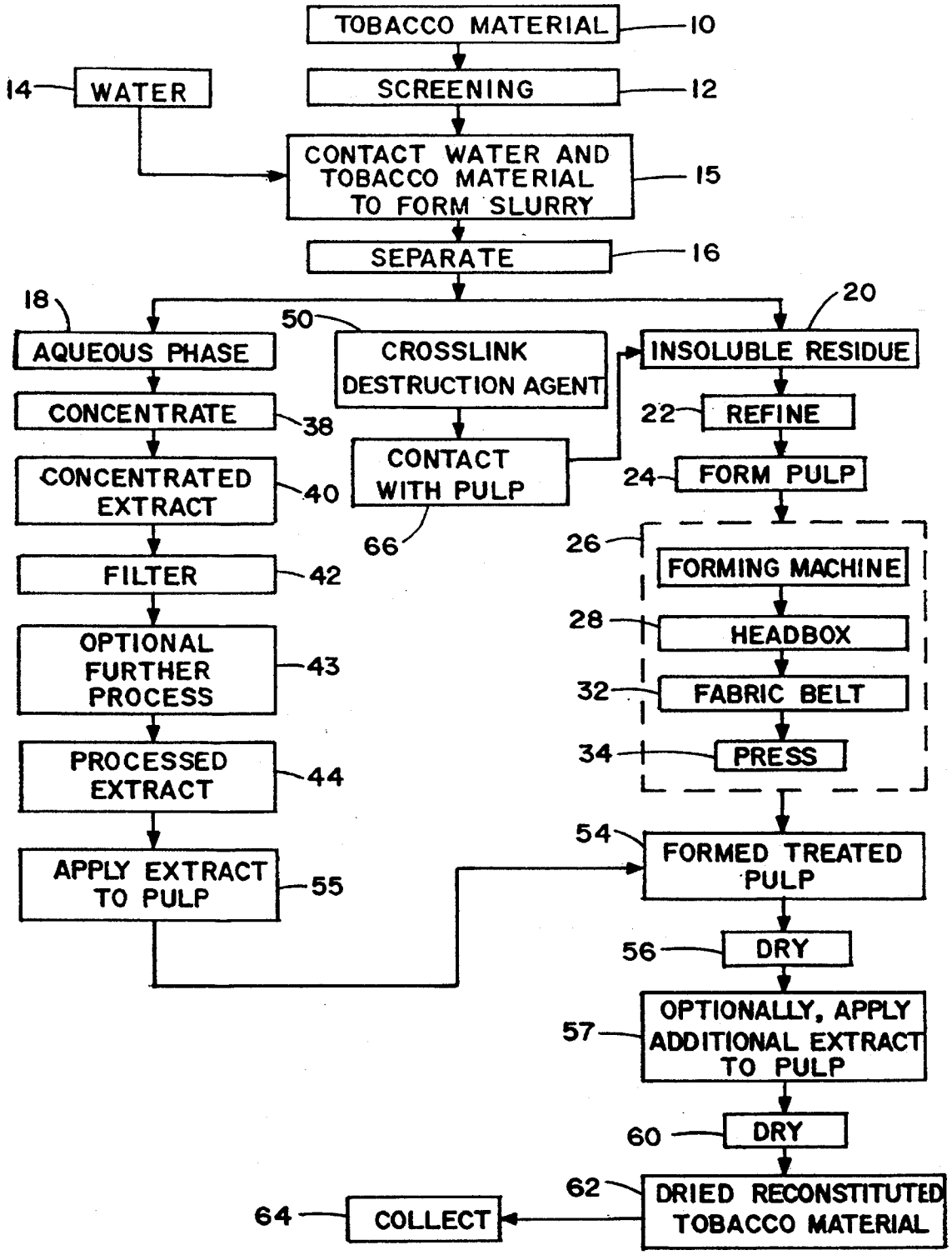

Referring to FIG. 2, a reconstituted tobacco material is provided essentially as described with reference to FIG. 1. However, the water insoluble residue 20 is contacted with pectin release agent 44, and then subjected to formation into a sheet-like shape. In particular, the residue 20 is contacted 66 with pectin release agent 50, the residue is refined 22, and the refined pulp 24 which results is transferred to a forming machine 26 to provide a formed treated pulp 54. As such, the pectin release agent is applied to the extracted tobacco material prior to the time that the tobacco pulp is formed into the desired shape, rather than after the time that the pulp is formed into the desired shape.

Plant materials used in the process of the present invention can vary. Most preferably, the plant materials are tobacco materials. The tobacco materials which are reconstituted according to the present invention are of a form such that, under extraction conditions, a portion thereof is soluble in (i.e., extracted by) the extraction solvent; and a portion thereof is insoluble in (i.e., not extracted by) the extraction solvent. The insoluble portion includes polymeric materials, such as cellulosics, pectins, and the like. Examples of suitable types of tobaccos include flue-cured, Oriental, Burley and Maryland tobaccos, although other types of tobacco can be employed. The tobacco material generally has been aged, and can be in the form of laminae (e.g., strip or cut filler) and/or stem, or can be in a processed form (e.g., previously reconstituted or volume expanded). Typically, the tobacco material employed is a waste material and/or processing by-product such as fines, dust, scrap or stem. All or part of the tobacco material can be previously cased and/or top dressed. The aforementioned materials can be processed separately, or as blends thereof.

The tobacco material is contacted with a solvent having an aqueous character. Such a solvent consists primarily of water, normally greater than 90 weight percent water, and can be essentially pure water in certain circumstances. Essentially pure water includes deionized water, distilled water and tap water. However, the solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 part ethanol.

The amount of tobacco material which is contacted with the solvent can vary. Typically, the weight of solvent relative to the tobacco material is greater than 4:1, and oftentimes greater than 5:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and solvent is not particularly critical. Representative methods for extracting tobacco materials with solvents are set forth in U.S. Pat. Nos. 5,005,593 to Fagg and 5,025,812 to Fagg, et al.; and U.S. patent application Ser. Nos. 505,339, filed Apr. 5, 1990now U.S. Pat. No. 5,095,922; 484,587, filed Feb. 23, 1990 now U.S. Pat. No. 5,065,775; 680,207, filed Apr. 4, 1991 now U.S. Pat. No. 5,131,415; 720,308, filed Jun. 25, 1991 now U.S. Pat. No. 5,131,414; and 733,477, filed Jul. 22, 1991; which are incorporated herein by reference.

The conditions under which the extraction is performed can vary. Typical temperatures range from about 50° F. to about 175° F. The solvent/tobacco material mixture can be agitated (e.g., stirred, shaken, or otherwise mixed) in order to increase the rate at which extraction occurs. Typically, adequate extraction of components occurs in less than about 60 minutes, and oftentimes in less than about 30 minutes. As such, an aqueous tobacco slurry is provided.

The solvent and tobacco extract components are separated from the insoluble residue. The manner of separation of the components of the slurry can vary; however, it is convenient to employ conventional separation means such as filtration, centrifugation, pressing, or the like. Generally, the separation of the components of the slurry is performed while the slurry is maintained at above ambient temperature. It is desirable to provide a solution of solvent and extracted components having a very low level of suspended solids, while removing the greatest amount of solvent from the insoluble residue as is possible. Typically, the separation of the components of the aqueous tobacco slurry is performed in order to provide (i) a damp pulp; and (ii) an aqueous extract having extracted tobacco components therein. Preferably, the damp pulp has as much extract as possible removed therefrom. The aqueous extract can be concentrated for further use, or spray dried for storage and handling reasons and later dissolved in aqueous solvent.

The pulp is formed into a sheet, or other desired shape. Normally, the pulp is an extracted tobacco material having a low water extractables content. Oftentimes, as much of the water extractables as possible is removed from the pulp such that essentially no water extractables are in contact with the pulp. The pulp normally is an extracted tobacco material having less than about 25 weight percent, often less than about 20 weight percent, frequently less than about 15 weight percent, and preferably less than about 10 weight percent water extractables, on a dry weight basis. Removal of a significant amount of the extractables is desirable in order that a significant amount of water soluble alkaline earth metal ions are removed from the pulp. As such, affects of such ions during the alkaline earth metal crosslink destruction step are minimized or eliminated. As such, low levels of crosslink destruction agent may be needed to provide the required release of tobacco pectins, resulting in flexibility in process steps, as well as savings in time and use of crosslink destruction agent. Typically, the pulp is laid onto a fabric, screen or wire mesh belt using known papermaking techniques and equipment. Oftentimes, damp pulp is contacted with further aqueous liquid to provide a slurry of sufficiently low solids content so as to have the pulp in a form which can be readily formed as a sheet on a fabric, screen or wire mesh belt. The formed pulp then is treated to remove excess water therefrom by passing the pulp through a series of presses, dryers, vacuum boxes, or the like. Techniques for removing excess water from formed pulp will be apparent to the skilled artisan. If desired, the pulp can be formed into the desired shape using casting or extrusion techniques, or the like.

If desired, the tobacco pulp can be combined with other materials, preferably prior to the time that the pulp is formed into the desired shape. For example, wood pulp fibers, flax fibers and other types of organic materials, and/or inorganic filler materials, can be combined with the tobacco pulp (e.g., usually at amounts of less than about 20 percent, and frequently less than about 10 percent, based on the dry weight of the tobacco pulp). Also, if desired, the tobacco pulp can be subjected to physical or chemical treatment. See, for example, U.S. patent application Ser. No. 710,273, filed Jun. 4, 1991.

The conditions under which the crosslink destruction agent is contacted with the extracted tobacco material can vary. The extracted tobacco material preferably has a relatively high moisture content, and most preferably is hydrated such that (i) the crosslink destruction agent can readily penetrate the extracted tobacco material and cause the tobacco pectins thereof to be released or otherwise liberated from a crosslinked form, and (ii) the pectins can exhibit a propensity to undergo rearrangement or otherwise experience movement throughout the extracted tobacco material. Typically, the moisture content of the extracted tobacco material is greater than about 60 percent, preferably greater than about 70 percent, based on the weight of the tobacco material and aqueous liquid. Normally, the moisture content of the extracted tobacco material ranges from about 60 to about 85 percent, preferably about 70 to about 80 percent, based on the weight of the tobacco material and aqueous liquid. The pH of the aqueous liquid in contact with the extracted tobacco material during the period when the extracted tobacco material is contacted with the crosslink destruction agent depends upon the selection of the particular crosslink destruction agent.

The extracted tobacco material is contacted with an agent capable of destroying the alkaline earth metal crosslinks of pectins present within that material. Such an agent commonly is referred to as a "crosslink destruction agent" or a "pectin release agent." Suitable crosslink destruction agents are those which exhibit a $K_{sp}$ with calcium ions which is less than that $K_{sp}$ exhibited by the calcium ions and functionalities of the tobacco pectins which form the crosslinks of the pectins, under those conditions which the crosslink destruction agent is contacted with the extracted tobacco material. Such crosslink destruction agents have a propensity to form salts of low solubility in water (i.e., form precipitates) or to act as chelating agents for calcium ions. Exemplary crosslink destruction agents include salts of $PO_4^{-3}$, $HPO_4^{-2}$ and $H_2PO_4^{-1}$. Representative water soluble phosphate salts include trisodium phosphate, disodium phosphate, monosodium phosphate and diammonium hydrogen orthophosphate. See, also, those pectin release agents proposed in U.S. Pat. No. 3,435,829 to Hind, et al., which is incorporated herein by reference. Normally, the crosslink destruction agent is provided in solution form (e.g., as about a 1 weight percent to about 30 weight percent solution in water) and then contacted with the extracted tobacco material to ensure destruction of the alkaline earth metal ion crosslinks of the pectins within such extracted tobacco material. The temperature of the extracted tobacco material and crosslink destruction agent during contact can vary, but usually ranges from about 20° C. to about 80° C., preferably about 25° C. to 45° C. If desired, the crosslink destruction agent can be formed in situ by contacting the tobacco pulp with separate components (e.g., an aqueous solution of ammonium hydroxide and an aqueous solution of phosphoric acid can be separately applied to the pulp).

The amount of crosslink destruction agent which is contacted with the extracted tobacco material can vary, and can depend upon the particular crosslink destruction agent. Typically, the amount of crosslink destruction agent is sufficient to form precipitates with the alkaline earth metal ions which crosslink the tobacco pectins. However, the amount of crosslink destruction agent should not be so high as to require the application of exceedingly high levels of alkaline earth metal ions (e.g., as tobacco extract and/or as water soluble alkaline earth metal salts) to the pulp in order to cause the re-crosslinking of the released tobacco pectins. That is, it is desirable to apply sufficient pectin release agent to the tobacco pulp to release the pectins within the pulp; while it is desirable to avoid the application of a great excess pectin release agent so that the tobacco extract or other source of alkaline earth metal ions which is applied later in the process steps is employed to re-crosslink the released tobacco pectins rather than interact with pectin release agent. Typically, the amount of crosslink destruction agent ranges from about 1 percent to about 6 percent, preferably about 2 percent to about 5 percent, based on dry weight of the tobacco pulp to which that agent is applied.

Preferably, the pectin release agent is contacted with the extracted tobacco material after the extracted tobacco material has been formed into the desired (e.g., sheet-like) shape. However, the pectin release agent also can be contacted with the extracted tobacco material prior to or during the time that the extracted tobacco material is formed into the desired shape. For example, in a paper making process, the pectin release agent and extracted tobacco material can be combined during refining of the pulp, as the pulp enters the headbox, when the pulp is in the headbox, as the pulp exits the headbox, as the pulp is introduced to the sheet forming region of the papermaking apparatus, in the sheet forming region of the papermaking apparatus, or in the final region of the papermaking apparatus (e.g., in the suction region of the apparatus) when the moisture content of the pulp is less than about 90 percent, based on the weight of the tobacco material and aqueous liquid.

The extracted tobacco material is subjected to conditions sufficient to allow release of the tobacco pectins with the extracted tobacco material. For certain pectin release agents, such conditions typically involve providing the aqueous liquid in contact with the pulp at pH sufficiently high so as to provide the moist pulp at a pH of about 6 to about 10, preferably about 7 to about 10. As such, the pH of the aqueous liquid in contact with the pulp can be made sufficiently high to allow release of the pectins at the time that the extracted tobacco material is contacted with the crosslink destruction agent. Alternatively, the pH of the aqueous liquid in contact with the pulp can be made sufficient to allow destruction of the alkaline earth metal crosslinks of the pectins at the time that the extracted tobacco material is contacted with the crosslink destruction agent, and then the pH of the aqueous liquid in contact with the pulp can be made sufficient to allow release and migration of the pectins.

The pH of the solvent is provided at the desired level using pH adjusting agents such as ammonium hydroxide, anhydrous ammonia, potassium hydroxide, sodium hydroxide, and the like.

The liquid extract is concentrated. Typically, the aqueous phase is evaporated such that the concentrated extract includes more than about 20 percent tobacco extract components, preferably about 24 to about 27 percent tobacco extract components, based on the weight of the extract components and solvent. The pH of the liquid extract generally ranges from about 4.5 to about 5.5. It is desirable to provide the liquid extract at conditions under which the alkaline earth metal ions therein (e.g., calcium ions) are soluble, and hence available to crosslink with the released pectins within the tobacco pulp.

If desired, certain components can be incorporated into the aqueous tobacco extract. For example, a compound such as urea, propylene glycol, glycerine, potassium sorbate, sugars, amino acids, flavors (e.g., licorice and cocoa), particulate matter (e.g., carbon particles), organic acids (e.g., citric acid, malic acid and levulinic acid), further tobacco extracts (e.g., heat treated tobacco extracts), and the like, and other casing, top dressing and particulate components, can be incorporated into the aqueous tobacco extract.

The formed pulp then is subjected to conditions sufficient to cause the released pectins to undergo crosslinking. Preferably, the aqueous tobacco extract or other agent capable of providing alkaline earth metal ions, such as calcium ions (e.g., an aqueous solution of calcium chloride) is applied to the formed pulp. The calcium ions are those calcium ions in a water soluble form, and can be provided as a mixture of aqueous tobacco extract and water soluble calcium salt. The amount of water soluble alkaline earth metal ions contacted with the formed pulp is at least sufficient to cause the released pectins to undergo alkaline earth metal crosslinking. For example, the aqueous tobacco extract is uniformly applied to the pulp in a sheet-like form using a series of spray nozzles, a series of sizing rollers, or other such means. However, the manner of applying the aqueous extract to the pulp is not particularly critical. The amount of extract applied to the extracted tobacco can vary; and can equal the amount of extract removed from the tobacco material during extraction, can be less than the amount of extract removed from the tobacco material during extraction, or can be more than that amount of extract removed from the tobacco material during extraction (e.g., by blending extracts). Normally, the moisture content of the pulp just prior to the time that the aqueous tobacco extract is applied thereto ranges from about 60 to about 85 percent, based on the weight of the pulp and moisture; and a formed pulp having a sheet-like shape is such that the weight thereof is greater than about 20 $g/m^2$, preferably about 25 $g/m^2$ to about 55 $g/m^2$, and more preferably about 30 $g/m^2$ to about 50 $g/m^2$, on a dry weight basis. The formed pulp having the aqueous tobacco extract applied thereto is dried to remove moisture therefrom using tunnel-type dryers, or the like. One or more applications of the aqueous tobacco extract can be provided to the formed pulp. The resulting tobacco material is dried to a moisture content of about 10 to about 15 weight percent, preferably to a moisture content of about 12 to about 13 weight percent.

When a phosphate salt (e.g., diammonium hydrogen orthophosphate) is used as a crosslink destruction agent, the amount of phosphate salt present within the resulting reconstituted tobacco material normally depends upon factors such as (i) the amount of salt applied to the tobacco pulp, and (ii) the amount of extract which is applied to the pulp to provide the resulting reconstituted tobacco material, and (iii) flavor characteristics of the final material which are desired. The resulting reconstituted tobacco material normally exhibits a phosphate content of about 1 to about 3.0 percent, preferably about 1.5 to about 2.5 percent (on a dry weight basis). Normally, such an exemplary reconstituted tobacco material, which is provided using diammonium hydrogen orthophosphate and ammonium hydroxide according to the process of the present invention, exhibits an ammonia content of about 0.4 to about 1.2 percent (on a dry weight basis).

If desired, tobacco dust can be incorporated into the reconstituted tobacco material. For example, tobacco dust (e.g., having a particle size of about 40 U.S. mesh or less) can be incorporated into the pulp prior to formation as a sheet, air laid onto the formed pulp prior to the time that the aqueous tobacco extract is applied to the formed sheet, air laid onto the formed pulp after the time that the aqueous tobacco extract is applied to the formed sheet, mixed with the aqueous tobacco extract and applied to the formed sheet, or sprayed onto the formed pulp as an aqueous slurry before, during or after the time that the aqueous tobacco extract is applied to the formed sheet. Typically, as much as about 15 percent, and often as much as about 20 percent, of the final dry weight of final reconstituted tobacco material can be provided by tobacco dust.

The reconstituted tobacco material exhibits excellent wet strength properties. The final or finished reconstituted tobacco material exhibits excellent sensory attributes (e.g., flavor, aroma, harshness, mildness and aftertaste). That material typically exhibits a dry basis weight of about 90 $g/m^2$ to about 120 $g/m^2$.

The following examples are provided in order to further illustrate various embodiments of the invention but should not be construed as limiting the scope thereof. Unless otherwise noted, all parts and percentages are by weight.

EXAMPLE 1

Reconstituted tobacco sheet is provided using a papermaking process generally as described with reference to FIG. 1 using tobacco by-products comprising a blend of tobacco types. The blend includes about 65 parts Burley and flue cured tobacco stems and about 35 parts of tobacco laminae dust and scrap.

The tobacco is extracted at about 140° F. using about 8 parts tap water for each part tobacco material. The resulting slurry of tobacco material in water is allowed to set for about 20 minutes, and the resulting tobacco pulp is subjected to a shredding or fiber opening by passing the slurry through a disc refiner having a plate opening of about 20 mm to about 30 mm. A slurry containing about 300 pounds of tobacco material, is passed through the disc refiner for about 20 minutes. The resulting aqueous tobacco extract is separated from the water insoluble pulp using a centrifuge. The pulp, which has a very low remaining water extractables content, is provided as a slurry in water at a solids content of about 1.5 to about 2.5 percent, and refined in a conical refiner to a Canadian Standard Freeness of about 125 to about 175 ml. The refined slurry is diluted using a recirculated forming water from the papermaking process to provide a diluted slurry having a solids content of about 0.6 to about 1.0 percent. The diluted slurry is formed into a sheet on a fabric belt of a papermaking apparatus, the operation of which will be apparent to the skilled artisan. The pulp is formed into a continuous sheet having dry basis weight of about 40 to about 50 g/m$^2$. A vacuum is pulled on the bottom of the fabric belt as is common in the papermaking industry so as to provide a damp, formed pulp having a moisture content of about 85 percent. The formed pulp is passed through a roller press to provide a damp pulp having a moisture content of about 70 to about 75 percent.

A solution of about 1.25 kg diammonium hydrogen orthophosphate, about 2.67 kg ammonium hydroxide (29.5 percent concentrated in water) and about 26.1 kg tap water is provided at ambient temperature. The solution then is sprayed onto the formed tobacco pulp using a sprayer at 216 g solution/min. or about 0.028 g pectin release agent/g dry pulp. The pulp moves on the fabric belt at a rate of about 80 ft/min., which is 76.6 ft$^2$/min. of pulp, or about 319 g dry pulp/min.

The liquid extract is concentrated using an evaporator to a concentration of about 26 percent tobacco extract and about 74 percent water. The liquid extract exhibits a pH of about 5, and is heated to about 130° F.

The liquid extract then is sprayed onto the sheet which is formed from the insoluble pulp, about 10 seconds after the pectin release solution is sprayed onto the pulp, such that a resulting sheet having a tobacco extract content of about 41 percent (on a dry weight basis) is provided. The sheet so provided is dried by the application of heat in a tunnel dryer to a moisture level of about 12 to about 13 percent. The resulting reconstituted tobacco sheet has a phosphate content of about 1.9 percent, an ammonia content of about 0.65 percent, and a dry basis weight of about 109 g/m$^2$. The resulting sheet exhibits good wet strength.

EXAMPLE 2

Reconstituted tobacco sheet is provided using a papermaking process generally as described with reference to FIG. 1. Tobacco material is provided, extracted using water, and the resulting tobacco pulp is formed into a continuous web or sheet, essentially as described in Example 1. The sheet has a moisture content of about 70 to about 75 percent. The dry basis weight of the sheet which is continuously provided is about 42 g/m$^2$, the width of the sheet on the fabric belt is about 11.5 inches, and the fabric belt (and hence the sheet) is moved at a rate of about 80 ft/min.

A solution of about 30 g diammonium hydrogen orthophosphate, about 130 g ammonium hydroxide (29.5 percent concentrated in water) and about 470 g water is provided at about ambient temperature. The solution is sprayed continuously onto a 2 inch wide section of the sheet, using a Chromist Spray Unit from Gelmen Instrument Co., as the sheet passes by at a rate of about 80 ft/min., so as to provide a treated portion of the web. None of the solution is sprayed onto the remaining 9.5 inch width of the sheet, so as to provide an untreated portion of the web.

About 10 seconds after the solution is sprayed onto the sheet (i.e., slightly downstream on the papermaking apparatus), liquid tobacco extract is sprayed onto the total width of the continuous web. The liquid extract is concentrated using an evaporator to a concentration of about 24 percent tobacco extract and about 76 percent water prior to application to the formed pulp. Resulting sheet so provided is dried by the application of heat in a tunnel dryer to a moisture level of about 12 to about 13 percent. The resulting sheet, on the untreated portion has a tobacco extract content of about 37 percent (on a dry weight basis), an ammonia content of about 0.13 percent, a phosphorus content of about 0.31 percent, and exhibits a pH of about 5.3. The reconstituted tobacco sheet, on the treated portion, has a tobacco extract content of about 34 percent (on a dry weight basis), an ammonia content of about 0.7 percent, a phosphorous content of about 0.75 percent, and exhibits a pH of about 5.96. The reconstituted sheet which is treated with crosslink destruction agent exhibits much higher wet strength than the reconstituted sheet not treated with crosslink destruction agent.

EXAMPLE 3

Reconstituted tobacco sheet is provided using a papermaking process generally as described with reference to FIG. 1. Tobacco material is provided, extracted using water, and the resulting tobacco pulp is formed into a continuous web or sheet, essentially as described in Example 1. The web or sheet has a moisture content of about 70 to 75 percent. The dry basis weight of the sheet which is continuously provided is about 44 g/m$^2$ to about 46 g/m$^2$, and the width of the sheet on the fabric belt is about 11.5 inches. With the pulp feed rate held constant at the headbox of the papermaking apparatus, the fabric belt (and hence the sheet) is moved at a rate of speed of about 75 ft/min. to about 100 ft/min.

A solution of about 1.25 kg diammonium hydrogen orthophosphate, about 2.67 kg ammonium hydroxide (29.5 percent concentrated in water) and about 26.08 kg tap water is provided at ambient temperature. This solution is sprayed continuously onto the fabric belt which carries the sheet. The solution is sprayed onto the sheet so as to penetrate the web or sheet with the crosslink destruction agent. The spraying apparatus is positioned in such a manner as to provide a continuous, constant and homogenous application across the fabric belt. The spraying apparatus application rate to the sheet is about 290 g of solution per minute. The solution is sprayed onto the pulp after the pulp has been laid onto the fabric belt, passed through a series of presses to remove water from the pulp, transferred to a later fabric belt, but prior to the time that the pulp is transferred to a rotary drum dryer set at about 200° F. The resulting treated pulp sheet exhibits increased wet strength and flexibility as compared to a similar but untreated pulp sheet.

About 10 seconds or less after the solution is sprayed onto the sheet (i.e., slightly downstream on the papermaking apparatus), liquid tobacco extract is sprayed onto the total width of the continuous web. The liquid extract which is sprayed onto the treated pulp previously has been concentrated using an evaporator so as to provide an aqueous tobacco extract having concentration of about 24 percent extract and about 76 percent water prior to application to the formed pulp. Resulting sheet so provided is dried by the application of heat in a tunnel dryer to a moisture level of about 12 to about 13 percent. The resulting treated reconstituted sheet has a tobacco extract content of about 37 percent (on a dry weight basis).

EXAMPLE 4

Reconstituted tobacco sheet is provided essentially as described in Example 3. However, the fabric belt is moved at a rate of speed of about 125 ft/min. so as to provide a sheet of pulp having a dry basis weight of about 37 g/m$^2$. The pectin release solution and the tobacco extract are applied to the sheet at the same rate as set forth in Example 3.

EXAMPLE 5

Reconstituted tobacco sheet is provided essentially as described in Example 3. However, the fabric belt is moved at a rate of speed of about 150 ft/min. so as to provide a sheet of pulp having a dry basis weight of about 29 g/m$^2$. The pectin release solution and the tobacco extract are applied to the sheet at the same rate as set forth in Example 3.

EXAMPLE 6

Reconstituted tobacco sheet is provided essentially as described in Example 3. However, the fabric belt is moved at a rate of speed of about 175 ft/min. so as to provide a sheet of pulp having a dry basis weight of about 24.5 g/m$^2$. The pectin release solution and the tobacco extract are applied to the sheet at the same rate as set forth in Example 3.

What is claimed is:

1. A process for providing a reconstituted plant material, the process comprising the steps of:

(a) extracting components from plant material having pectins using a solvent having an aqueous character thereby providing (i) a solvent having plant extract components therein, and (ii) a plant portion insoluble in the solvent; (b) separating at least a portion of the solvent and extract components therein from the insoluble plant portion;

(c) forming the insoluble plant portion provided in step (b) into a predetermined shape;

(d) contacting the plant portion provided in step (c) with a pectin release agent under conditions sufficient to release pectins within the plant portion;

(e) providing the portion of solvent and extract components provided in step (b) in a form capable of being applied to the plant portion of step (d); and (f) contacting the plant portion of step (d) with the solvent and extract components of step (e) so as to crosslink the released pectins and to provide a reconstituted plant material.

2. The process of claim 1 whereby the plant material is a tobacco material.

3. The process of claim 2 whereby the moisture content of the plant portion provided in step (c) ranges from 60 percent to about 85 percent, based on the weight of the plant material and solvent.

4. The process of claim 2 whereby the insoluble plant portion provided in step (b) includes less than about 20 weight percent water extractables, on a dry weight basis.

5. The process of claim 2 whereby the pectin release agent includes diammonium hydrogen orthophosphate.

6. The process of claim 2 whereby the insoluble plant portion is formed into a sheet-like shape.

7. The process of claim 6 whereby the formed insoluble plant portion exhibits a basis weight of about 25 g/m$^2$ to about 55 g/m$^2$, on a dry weight basis.

8. The process of claim 2 whereby the plant material provided in step (f) is dried to a moisture content of about 10 to about 15 weight percent.

9. The process of claim 8 whereby the pectin release agent includes a water soluble phosphate salt, and the reconstituted plant material exhibits a phosphate content of about 1 to about 3 percent, on a dry weight basis.

10. The process of claim 8 whereby the pectin release agent includes a water soluble phosphate salt, and the reconstituted plant material exhibits a phosphate content of about 1.5 to about 2.5 percent, on a dry weight basis.

11. The process of claim 8 whereby the reconstituted plant material exhibits an ammonia content of about 0.4 to about 1.2 percent, on a dry weight basis.

12. The process of claim 8 whereby the reconstituted plant material exhibits a basis weight of about 90 g/m$^2$ to about 120 g/m$^2$, on a dry weight basis.

13. The process of claim 2 whereby pectin release agent is contacted with the plant portion in step (d) in an amount of about 1 to about 6 percent, on a dry weight basis of the plant portion to which the pectin release agent is contacted.

14. The process of claim 2 whereby pectin release agent is contacted with the plant portion in step (d) in an amount of about 2 to about 5 percent, on a dry weight basis of the plant portion to which the pectin release agent is contacted.

15. The process of claim 2 whereby the aqueous liquid in contact with the extracted plant portion after step (d) exhibits a pH of about 7 to about 10.

16. A process for providing a reconstituted plant material, the process comprising the steps of:

(a) extracting components from plant material having pectins using a solvent having an aqueous character thereby providing (i) a solvent having plant extract components therein, and (ii) a plant portion insoluble in the solvent;

(b) separating at least a portion of the solvent and extract components therein from the insoluble plant portion;

(c) forming the insoluble plant portion provided in step (b) into a predetermined shape;

(d) contacting the plant portion provided in step (c) with a pectin release agent under conditions sufficient to release pectins within the plant portion;

(e) subjecting the plant provided in step (d) to conditions sufficient to cause released pectins to undergo crosslinking.

17. The process of claim 16 whereby the plant material is a tobacco material.

18. The process of claim 17 whereby step (e) includes the steps of (i) providing a source of water soluble alkaline earth metal ions and solvent in a form capable of being applied to the plant portion of step (d), and (ii) contacting the plant portion of step (d) with the solvent and alkaline earth metal ions of step (i).

19. The process of claim 18 whereby the alkaline earth metal ions include calcium ions.

20. The process of claim 18 whereby the source of alkaline earth metal ions is a tobacco extract.

21. The process of claim 17 whereby the plant portion provided in step (e) is dried to a moisture content of about 10 to about 15 weight percent.

22. The process of claim 21 whereby the pectin release agent includes a water soluble phosphate salt, and the reconstituted plant material exhibits a phosphate content of about 1 to about 3 percent, on a dry weight basis.

23. The process of claim 21 whereby the pectin release agent includes a water soluble phosphate salt, and the reconstituted plant material exhibits a phosphate content of about 1.5 to about 2.5 percent, on a dry weight basis.

24. The process of claim 21 whereby the reconstituted plant material exhibits an ammonia content of about 0.4 to about 1.2 percent, on a dry weight basis.

25. The process of claim 21 whereby the reconstituted plant material has a sheet-like shape and exhibits a basis weight of about 90 $g/m^2$ to about 120 $g/m^2$, on a dry weight basis.

26. The process of claim 17 whereby pectin release agent is contacted with the plant portion in step (d) in an amount of about 1 to about 6 percent, on a dry weight basis of the plant portion to which the pectin release agent is contacted.

27. The process of claim 17 whereby pectin release agent is contacted with the plant portion in step (d) in an amount of about 2 to about 5 percent, on a dry weight basis of the plant portion to which the pectin release agent is contacted.

28. The process of claim 17 whereby the aqueous liquid in contact with the extracted plant portion after step (c) exhibits a pH of about 7 to about 10.

29. The process of claim 21 whereby the formed insoluble plant portion having a sheet-like shape exhibits a basis weight of about 25 $g/m^2$ to about 55 $g/m^2$, on a dry weight basis.

30. A papermaking process for providing a reconstituted plant material, the process comprising the steps of:

(a) extracting components from plant material having pectins using a solvent having an aqueous character thereby providing (i) a solvent having plant extract components therein, and (ii) a plant portion insoluble in the solvent;

(b) separating at least a portion of the solvent and extract components therein from the insoluble plant portion;

(c) providing a slurry of the insoluble plant portion in a liquid having a aqueous character (d) forming the insoluble plant portion provided in step (c) into a predetermined sheet-like shape using a papermaking apparatus;

(e) contacting the plant portion provided in step (d) with a pectin release agent under conditions sufficient to release pectins within the plant portion;

(f) providing the portion of solvent and extract components provided in step (b) in a form capable of being applied to the plant portion of step (e);

(g) contacting the plant portion of step (e) with the solvent and extract components of step (f) so as to crosslink the released pectins and to provide a reconstituted plant material; and (h) drying the reconstituted plant material provided in step (g).

31. The process of claim 30 whereby the plant material is a tobacco material.

32. The process of claim 31 whereby the insoluble plant portion formed in step (d) includes less than about 20 weight percent water extractables, on a dry weight basis.

33. The process of claim 31 whereby the pectin release agent includes diammonium hydrogen orthophosphate.

34. The process of claim 30 whereby the moisture content of the plant portion formed in step (d) ranges from about 60 percent to about 85 percent, based on the weight of the plant material and solvent.

35. A papermaking process for providing a reconstituted plant material, the process comprising the steps of:

(a) extracting components from plant material having pectins using a solvent having an aqueous character thereby providing (i) a solvent having plant extract components therein, and (ii) a plant portion insoluble in the solvent;

(b) separating at least a portion of the solvent and extract components therein from the insoluble plant portion;

(c) providing a slurry of the insoluble plant portion in a liquid having an aqueous character;

(d) forming the insoluble plant portion provided in step (c) into a sheet-like shape using a papermaking apparatus;

(e) contacting the plant portion provided in step (d) with a pectin release agent under conditions sufficient to release pectins within the plant portion;

(f) subjecting the plant portion provided in step (e) to conditions sufficient to cause released pectins to undergo crosslinking so as to crosslink the released pectins and to provide a reconstituted plant material; and (g) drying the reconstituted plant material provided in step (f).

36. The process of claim 35 whereby the plant material is a tobacco material.

37. The process of claim 36 whereby step (e) includes the steps of (i) providing a source of water soluble alkaline earth metal ions and solvent in a form capable of being applied to the plant portion of step (e), and (ii) contacting the plant portion of step (d) with the solvent and alkaline earth metal ions of step (i).

38. The process of claim 37 whereby the source of alkaline earth metal ions is a tobacco extract.

* * * * *